United States Patent [19]

Masuda

[11] 3,979,800

[45] Sept. 14, 1976

[54] BUCKLE

[76] Inventor: Kengo Masuda, c/o Masuda Manufacturing Co., Ltd., No. 23-1, Higashi-ueno 4 chome, Taito, Tokyo, Japan

[22] Filed: Nov. 7, 1975

[21] Appl. No.: 630,062

[30] Foreign Application Priority Data

Sept. 10, 1975 Japan ..... 50-124794

[52] U.S. Cl. ..... 24/191; 24/171

[51] Int. Cl.[2] ..... A44B 11/12

[58] Field of Search ..... 24/191, 170, 78, 76, 24/163

[56] References Cited

UNITED STATES PATENTS

| | | | |
|---|---|---|---|
| 1,447,268 | 2/1923 | Rust | 24/191 |
| 1,455,831 | 5/1923 | Chabot | 24/191 |
| 1,503,338 | 7/1924 | Shields | 24/191 |

*Primary Examiner*—Werner H. Schroeder
*Assistant Examiner*—Doris L. Troutman
*Attorney, Agent, or Firm*—William A. Drucker

[57] ABSTRACT

A buckle for use with a belt which is characterized in that the belt clamping element thereof has its lower or leg portion diversified in three radially directed wings which are adapted to be engaged within associated ones of juxtaposed transverse openings of the belt connecting member arranged in slidable engagement within the main body of the buckle.

Thus, said clamping element is housed within the main body of the buckle in a compact and little bulky fashion. The buckle is further characterized by having an ornamental upper side surface portion which is easily interchangeable with another one so that the buckle may have various ornaments of different tastes.

2 Claims, 3 Drawing Figures

(a)

(b)

BUCKLE

DESCRIPTION OF THE PRIOR ART

The present invention relates to improvements in or to buckles for use with belts. Particularly the improvements are directed to the clamping element of a buckle for maintaining the buckle in rigid engagement with a belt, and also to ornaments to be applied on the upper surface of the main body of a buckle.

In a conventional type of buckle, a clamping element which is of a generally triangular cross section with teeth formed on top thereof is pivotally mounted on the main body of the buckle in relation transverselly bridging between the side wall plates of the main body. Such buckle is assembled with the belt by pivoting the main body thereof with respect to the clamping element, then inserting the tip of the belt into space thus widened between the underside of the main body and the clamping element to a required extent, and thereafter pivoting the main body in the direction reverse to that of the preceding rotation to press the clamping element against the belt until the former bites the belt so sufficiently as to secure the belt to the buckle. Such rotation of the main body is also used to loosen or tighten the point of the belt where the buckle is secured to the belt, for shifting the belt with respect to the wearer's body. However, such buckle had the disadvantage that the clamping element was so bulkily configurated that the top and tail ends of the belt were inevitably spaced by a considerable distance from each other thus to prevent the buckle portion from having a flat or streamline style. For this reason the buckle failed to be a perfect fit, and the belt tended to be easily disengaged from the clamping element to cause the belt to be loosened against the wearer's will. This weakness is accentuated when the buckle and belt is worn by a fat man. Further, in the case that after the lapse of a long period of use, the belt was worn out to be reduced in thickness, the engagement of the clamping element and the main body of the buckle becomed ill to render the buckle and belt unit impossible to use any longer, and thus to shorten its service life.

On the other hand, usually the buckle body had its upper surface provided with an ornamental design. But, the whole buckle had to be replaced with another one with a different ornament, in the cases that the ornamented surface was abraded after a long time of use or was damaged by accident, and that the wearer wanted to wear another buckle provided with a different ornamentation when going out.

SUMMARY OF THE INVENTION

Therefore, the principal object of the present invention is to provide a buckle which has a pivotal clamping element housed within the main body of the buckle in such a compact and little bulky manner that when used, there is a smaller distance between the top end portion and tail end portion of the belt to allow the buckle portion to have a flat and streamlined arrangement, thereby enabling the buckle to fit any wearer nicely and be excellent in appearance.

Another object of the invention is to provide a buckle which has an ornamentally decorated upper side surface portion easily interchangeable with another one so that the buckle may have various ornaments of different tastes merely by interchanging the ornamented upper surface plate alone with a different one.

BRIEF DESCRIPTION OF DRAWINGS

The accompanying drawings show embodiments of the present invention, in which.

DETAILED DESCRIPTION OF THE INVENTION

Figure 1:
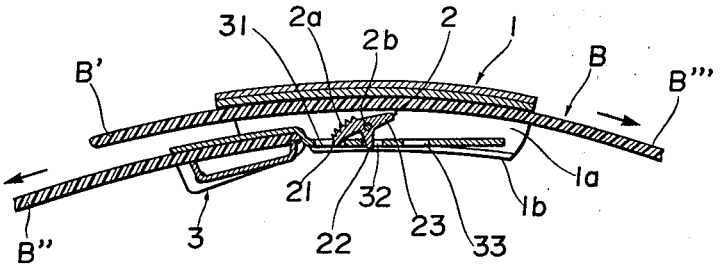
FIGS. 1 (*a*) (*b*) are longitudinally sectional views showing the function of the clamping element according to the invention.
Figure 1:
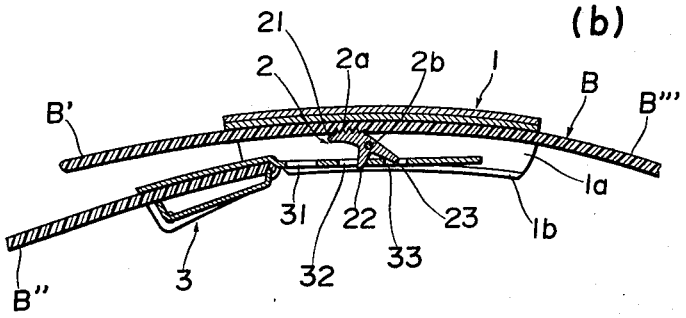
Figure 2:
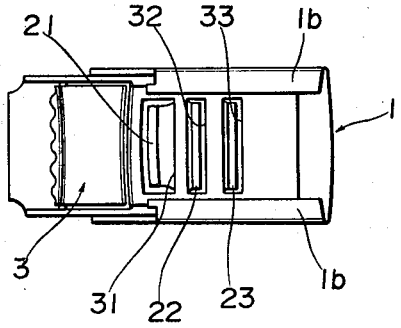
FIG. 2 is a bottom plan view showing the buckle with the clamping element according to the invention.

Referring first to FIGS. 1 and 2 of the accompanying drawings, description is made on a first improvement of the invention. A clamping element 2 is pivotally mounted on the main body 1 of the buckle in relation transverselly bridging between the opposite side walls 1*a* of the main body downwardly pending therefrom. The element 2 comprises three wings 21, 22, 23 radially directed from the axis 2*b* thereof and extending over a major part of the length thereof. The foremost and rearmost wings 21 and 23 are directed at acute angles with respect to the middle wing 22 so as to cooperate with each other to form a largely arcuate plane. The wings 21 and 23 may be directed at acuter angles relative to each other than the shown angles, e.g. nearly at right angles. The front wing 21 has its outer surface formed with transverse teeth 2*a*. Said side walls 1*a* have the lower portions inwardly bent to form supports 1*b* for supporting one end portion of a belt connecting member 3 for rigid connection with a tail end B'' of the belt B. Thus, the whole main body 1 of the buckle presents a tubular shape of a generally rectangular cross section. Said connecting member 3 has at least said end portion formed slightly smaller in width than the main body 1 of the buckle and slidably inserted between the side walls 1*a* and simultaneously between the element 2 and the supports 1*b*. The connecting member 3 further has a portion near the rear end thereof formed with three elongated openings 31, 32, 33 extending transverselly thereof, i.e. in the direction parallel with the extending direction of said wings 21, 22, 23, and arranged in juxtaposition. Said openings have such sizes as to receive the wings respectively, which in turn are adapted to be engaged in the openings when the clamping element is pivoted about its axis 2*b* by manually moving the connecting member 3 longitudinally within respect to the main body 1.

Next, description is made on the operation of this buckle. FIGS. 1 (*a*) and (*b*) show positions in which the top end portion B' of the belt B is inserted through the buckle body 1, and particularly FIG. 1(*a*) shows a position wherein the belt can be freely slided within the main body 1, and FIG. (*b*) another position wherein the belt is immovably clamped against the buckle. In the position shown in FIG. 1(*a*), the clamping element 2 has its front and intermediate wings 21, 22 engaged in the elongated openings 31, 32 of the connecting member 3 respectively, while the toothed surface 2*a* is spaced from the inner upper wall of the main body 1 to such an extent that the toothed surface 2*a* lightly touches the belt B inserted through the buckle. Thus, the top end portion B' of the belt B can be freely moved in the right and left directions seen in the drawings. At this position, if the portions B'' and B''' of the belt are pulled in the opposite directions relative to each other, i.e., in the directions as indicated by arrows in FIG. 1(*a*), the connecting member 3 is somewhat slided outwardly with respect to the main body 1 with movement of the belt to pivot the clamping element 2 clockwise by the urging action of side edges of the openings in engagement with the wings until the toothed surface 2*a* bites into the reverse side face of the belt. When the toothed surface 2*a* fully bites into the belt, the element 2 is prevented from further pivoting, and consequently the belt does not move further if drawn outwardly. At this time, at least the rearmost wing 23 is engaged within its associated opening 33. On the contrary, if the belt is urged inwardly, the element 2 is then pivoted counterclockwise and simultaneously the connecting member 3 is made to be slided inwards in the main body 1, thus returning to the position of FIG. 1(*a*) when the belt can be further freely moved inwardly. Since the pivotal movement of the element 2 is thus caused by the relative movement of the main body 1 and connecting member 3, if the main body and connecting member are both held with fingers so as to be prevented from making relative movements, also the clamping element is prevented from pivoting, so that the belt B can be freely pulled in the right direction until the belt is loosened to a desired length or pulled off the body. Further, also in the position of FIG. 1(*b*), if the main body 1 and connecting member 3 are moved in the inward directions, i.e., the latter is further inserted into the former, the clamping element 2 is pivoted couterclockwise to release the teeth 2*a* from the belt in which it bited, thus enabling the belt B to be pulled off. Incidentally, in addition to causing said pivotal motion of the clamping element 2, simultaneously the rear wing 23 has a function of obstructing unnecessary advancement of the connecting member 3, i.e., as a stopper in cooperation with the elongated opening 33 which is engageable by the rear wing 23.

Since the buckle according to the invention operates as stated above, in use, the top end portion B′ of the belt is first inserted through the main body 1 while the buckle is held with hand unitl the whole length of the belt reaches to a desired length. At this time, since the belt is moderately tightened, the belt, when the buckle is released from the hand, will receive tensile strength outwardly acting, so that the clamping element 2 is pivoted into the position of FIG. 1(*b*) to have its teeth 2*a* bit in the belt, thus being rigidly fastened thereto. The belt thus tightened is never loosened of itself. To further tighten the belt, it is sufficient to pull the top end portion B′ forwardly. Conversely, to loosen or remove the belt, the wearer has only to insert the connecting member 3 with respect to the main body 1, which releases the toothed surface 2*a* from the belt, so that the belt can be freely moved.

With the above-mentioned structure, the clamping element 2 is compactly housed within the main body 1 without being bulky so that when used, the top end portion B′ and tail end portion B″ are little spaced from each other to have the buckle portion present a flat configuration which allows the same portion to closely fit the wearer's body. Particularly, this advantage is not vitiated even in the case of the buckle being worn by a corpulent man: The buckle worn by him still maintains its flat configuration. To tighten or disengage the belt from the buckle, it is unnecessary to pivot the main body clockwise by a large angle until the clamping element is released from the main body, but all things to do are to slide the main body and connecting member in the directions approaching each other, thus simply enabling stable and positive disengagement of the belt from the buckle.

While I have shown and described certain present preferred embodiments of the invention it is to be distinctly understood that the invention is not limited thereto but may be otherwise variously embodied within the scope of the following claims.

What J claim is:

1. A buckle for use with a belt, comprising: a main body having a tubular shape of a generally rectangular cross section; first means pivotally mounted on said main body in relation transverselly bridging between opposite side walls of said main body for upwardly urging said belt inserted through said main body, said means comprising three wings radially directed from the axis thereof, a foremost one of which has an outer surface thereof formed with a plurality of transverse teeth; and second means having one end portion thereof slidably inserted through between a bottom portion of said main body and said first means, and having the other end thereof adapted to be connected with a tail end of said belt, said second means having a portion near said end portion formed with three transverse elongated openings arranged in juxtaposition which openings have such sizes as to receive associated ones of said wings respectively; whereby when said second means are slided into said main body, said first means are forwardly pivoted with the wings thereof disengageably engaged by said openings by urging force of said openings against respective ones of said wings, to bring said belt inserted through said main body into a freely movable state, and when said second means are slided outwardly with respect to said main body, said first means are pivoted rearwardly in a similar manner to that of said forward pivotal movement to urge said toothed surface against said belt thus fastening the belt with respect to the buckle.

2. The buckle as recited in claim 1, wherein foremost and rearmost ones of said wings are directed at acute angles with respect to an intermediate one of said wings.

* * * * *